US007316753B2

(12) United States Patent
Jung et al.

(10) Patent No.: US 7,316,753 B2
(45) Date of Patent: Jan. 8, 2008

(54) COHERENT NANODISPERSION-STRENGTHENED SHAPE-MEMORY ALLOYS

(75) Inventors: Jin-Won Jung, Evanston, IL (US); Gregory B. Olson, Riverwoods, IL (US)

(73) Assignee: QuesTek Innovations LLC, Evanston, IL (US)

( * ) Notice: Subject to any disclaimer, the term of this patent is extended or adjusted under 35 U.S.C. 154(b) by 284 days.

(21) Appl. No.: 10/809,082

(22) Filed: Mar. 25, 2004

(65) Prior Publication Data

US 2004/0187980 A1 Sep. 30, 2004

Related U.S. Application Data

(60) Provisional application No. 60/457,418, filed on Mar. 25, 2003.

(51) Int. Cl.
*C22C 19/03* (2006.01)

(52) U.S. Cl. ..... 148/402; 148/429

(58) Field of Classification Search ..... 148/402
See application file for complete search history.

(56) References Cited

U.S. PATENT DOCUMENTS 4,144,057 A * 3/1979 Melton et al. ..... 420/457
4,707,196 A * 11/1987 Honma et al. ..... 148/563
6,001,195 A * 12/1999 Kajiwara et al. ..... 148/402

OTHER PUBLICATIONS

Chen et al., "Martensite Lattice Changes During Tempering," Metall. Trans. A., vol. 11A, Aug. 1980, pp. 1333-1339.

Grujicic et al., "Mobility of Martensitic Interfaces," Metall. Trans. A., vol. 16A, Oct. 1985, pp. 1713-1722.

Ishida et al., "Microstructure of Ti-48.2 at. Pct Ni Shape Memory Thin Flims," Metall. Trans. A., vol. 28A, Oct. 1997, pp. 1985-1991.

Jung et al., "Precipitation of Heusler Phase (Ni2TiAl) from B2-TiNi in Ni-Ti-Al and Ni-Al-X (X=Hf, Zr Alloys," Metall. Trans. A., vol. 34A, Jun. 2003, pp. 1221-1235.

Kajiwara , S., "Development of Composition-Insensitive SMA Thin Films with High Recovery Strength and Large Recovery Strain," J. Phys. IV, vol. 11, 2001, pp. 395-405.

Kajiwara et al., "Stregthening of Ti-Ni Shape-Memory Films by Coherent Subnanometric Plate Precipitates," Philos. Mag. Lett., vol. 74, 1996, pp. 137-144.

Kajiwara et al., "Remarkable Improvement of Shape Memory Effect in Fe-Mn-Si Based Shape Memory Alloys by Producing NbC Precipitates," Scripta Mater., vol. 44, 2001, pp. 2809-2814.

Koizumi et al., "NiTi-base Intermetallic Alloys Strengthened by A1 Substitution," Mater. Sci. Engng A., vol. 223, 1997, pp. 36-41.

Lin et al., "The Tensile Behavior of a Cold-Rolled and Reverse-Transformed Equiatomic TiNi Alloy," Acta Metall. Mater., vol. 42, 1994, pp. 1623-1630.

(Continued)

*Primary Examiner*—George Wyszomierski
(74) *Attorney, Agent, or Firm*—Banner & Witcoff, Ltd.

(57) ABSTRACT

High-strength, low-hysteresis TiNi-based shape-memory alloys (SMAS) employing fully coherent low-misfit nanoscale precipitates, wherein the precipitate phase is based on an optimized composition for high parent-phase strength and martensite phase stability, and compensating the stored elastic energy through the addition of martensite stabilizers. The alloys, with a yield strength in excess of 1200 MPa, are useful for applications such as self-expanding stents, automotive actuators, and other applications wherein SMAs with high output force and long cyclic life are desired.

16 Claims, 9 Drawing Sheets

Systems design chart of coherent nanodispersion-strengthened SMAs.

OTHER PUBLICATIONS

Liu et al., "The Influence of Distribution of α Phase on Properties of Polycrystalline CuZnAl Shape Memory Alloy," Metall. Trans. A., vol. 23, Oct. 1992, pp. 2939-2941.

Yang et al., "Ductilization of Ti-Ni-Pd Shape Memory Alloys with Boron Additions," Scripta Metall. Mater., vol. 28, 1993, pp. 161-165.

Lovey et al., "On the Microstructural Characteristics of Non-equilibrium γ Precipitates in Cu-Zn-Al Alloys," Mater. Sci. Engng. A., vol. 129, 1990, pp. 127-133.

Morawiec et al., "Precipitation and Shape Recovery in CuAlNi+TiB Alloy," J. Phys. IV, vol. 5 (C2), 1995, pp. 193-197.

* cited by examiner

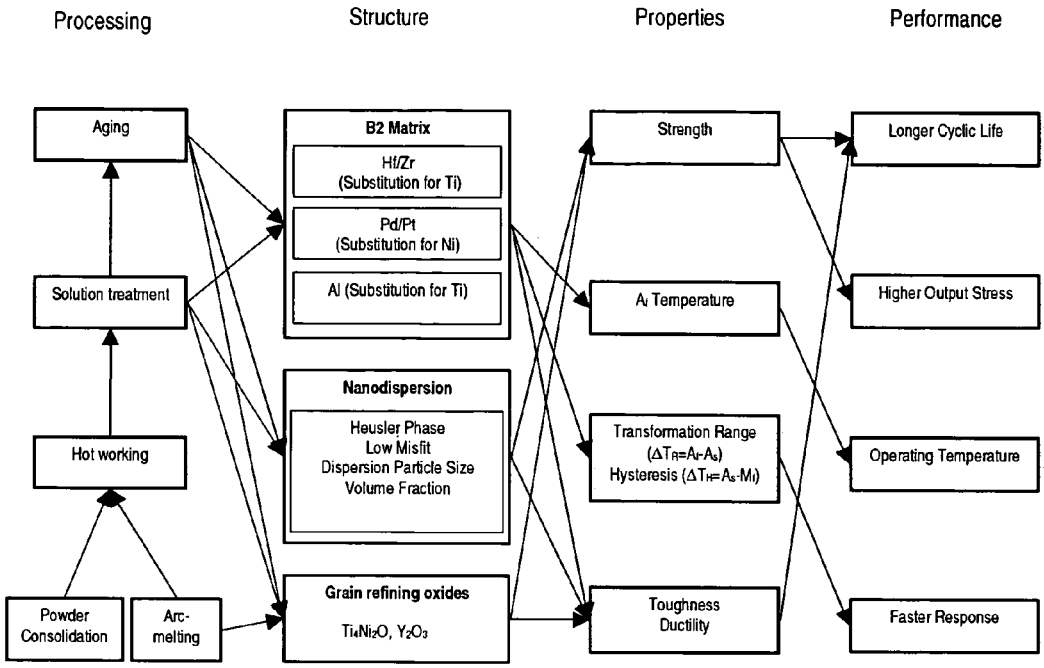
Figure 1: Systems design chart of coherent nanodispersion-strengthened SMAs.

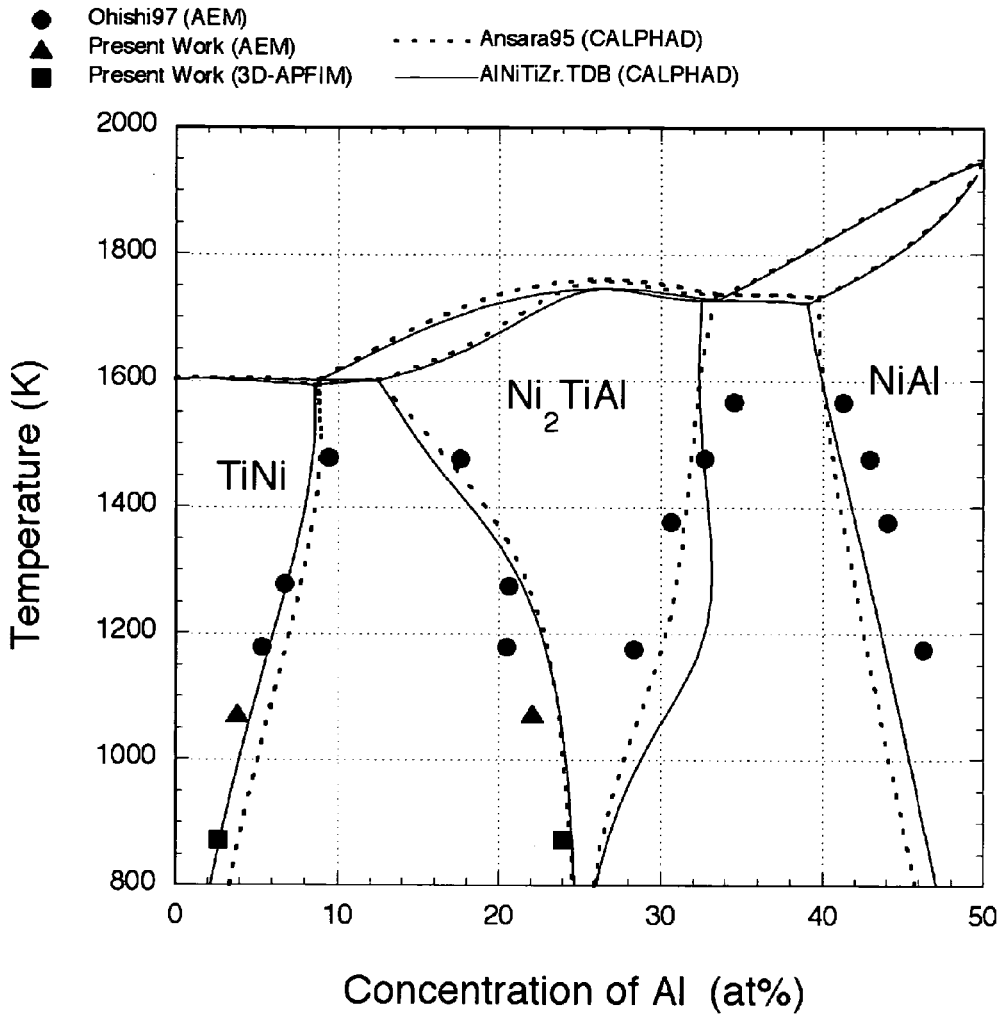
Figure 2: Calculated pseudo-binary phase diagram of TiNi-NiAl.

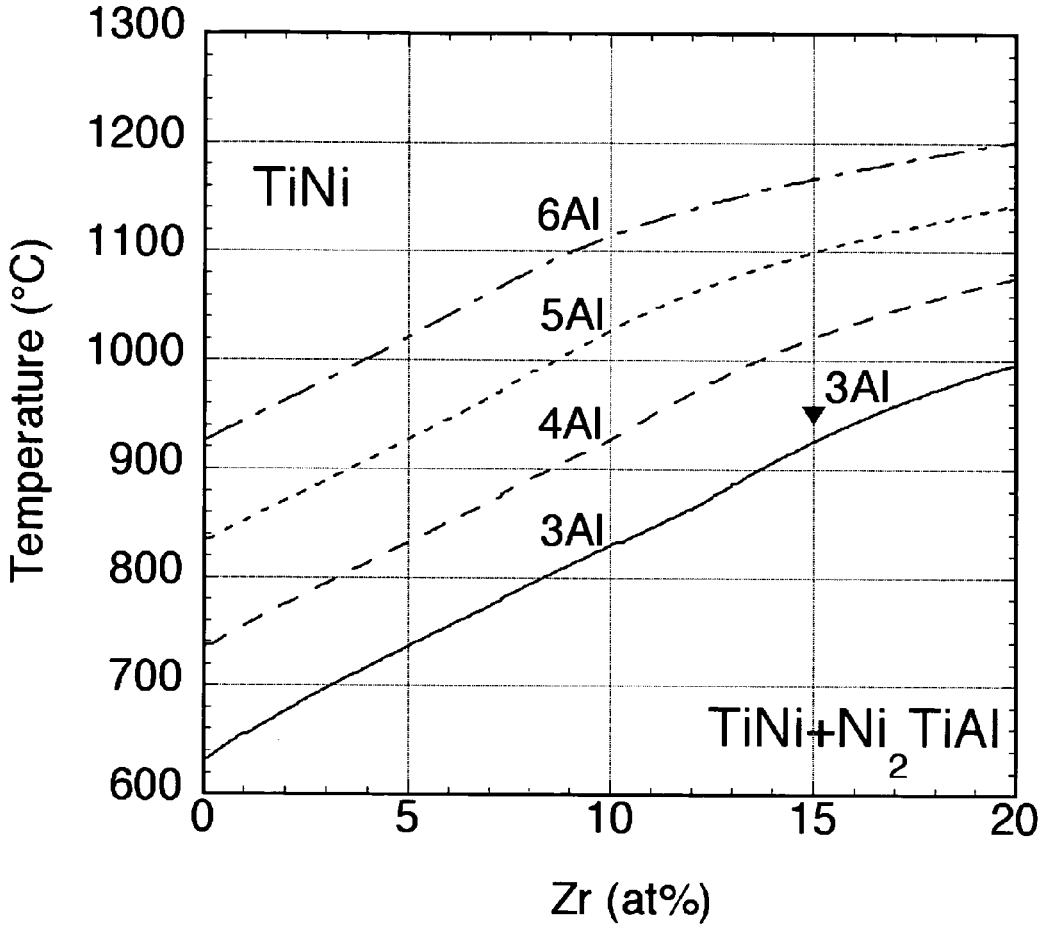
Figure 3: Solution Temperature vs. Zr Content.

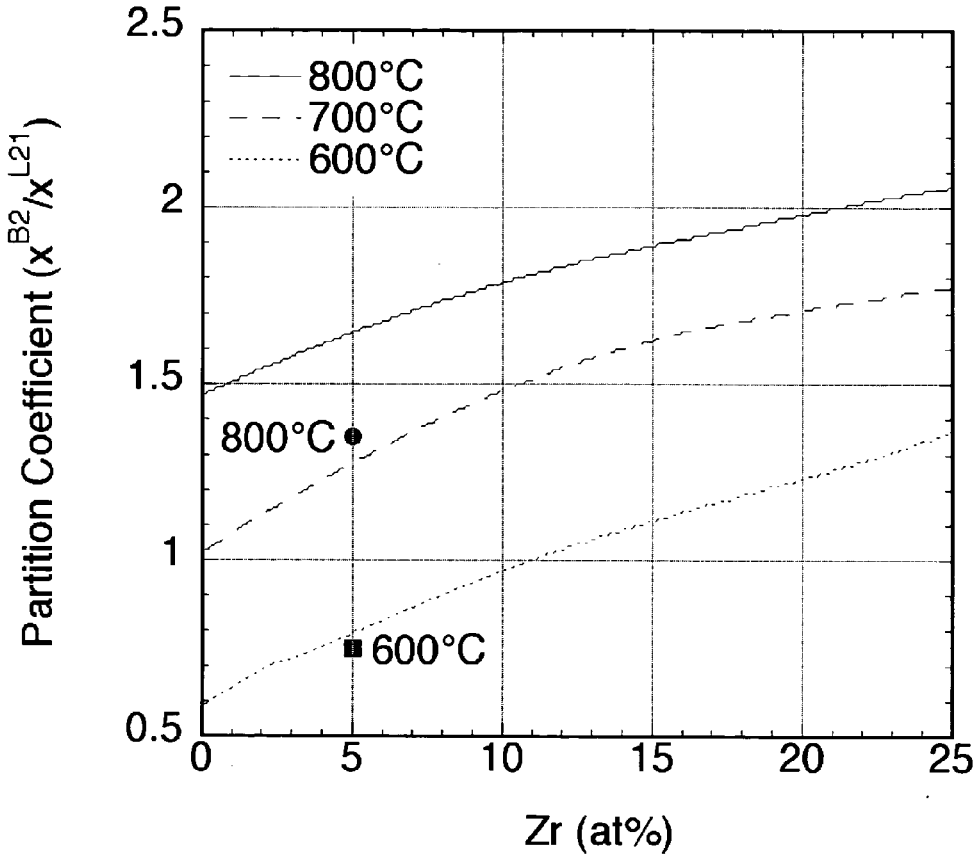
Figure 4: Partitioning of Zr between $B2$-TiNi and $L2_1$-Heusler phases.

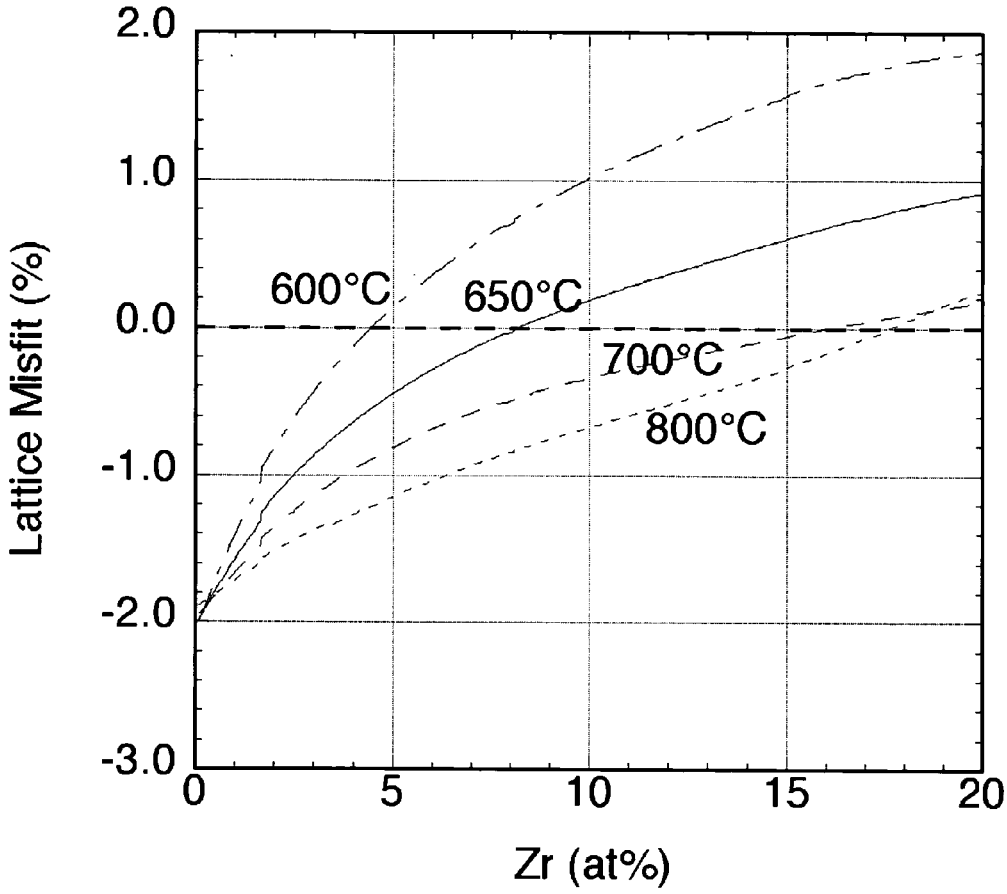
Figure 5: Ambient interphase lattice misfit vs. Zr content.

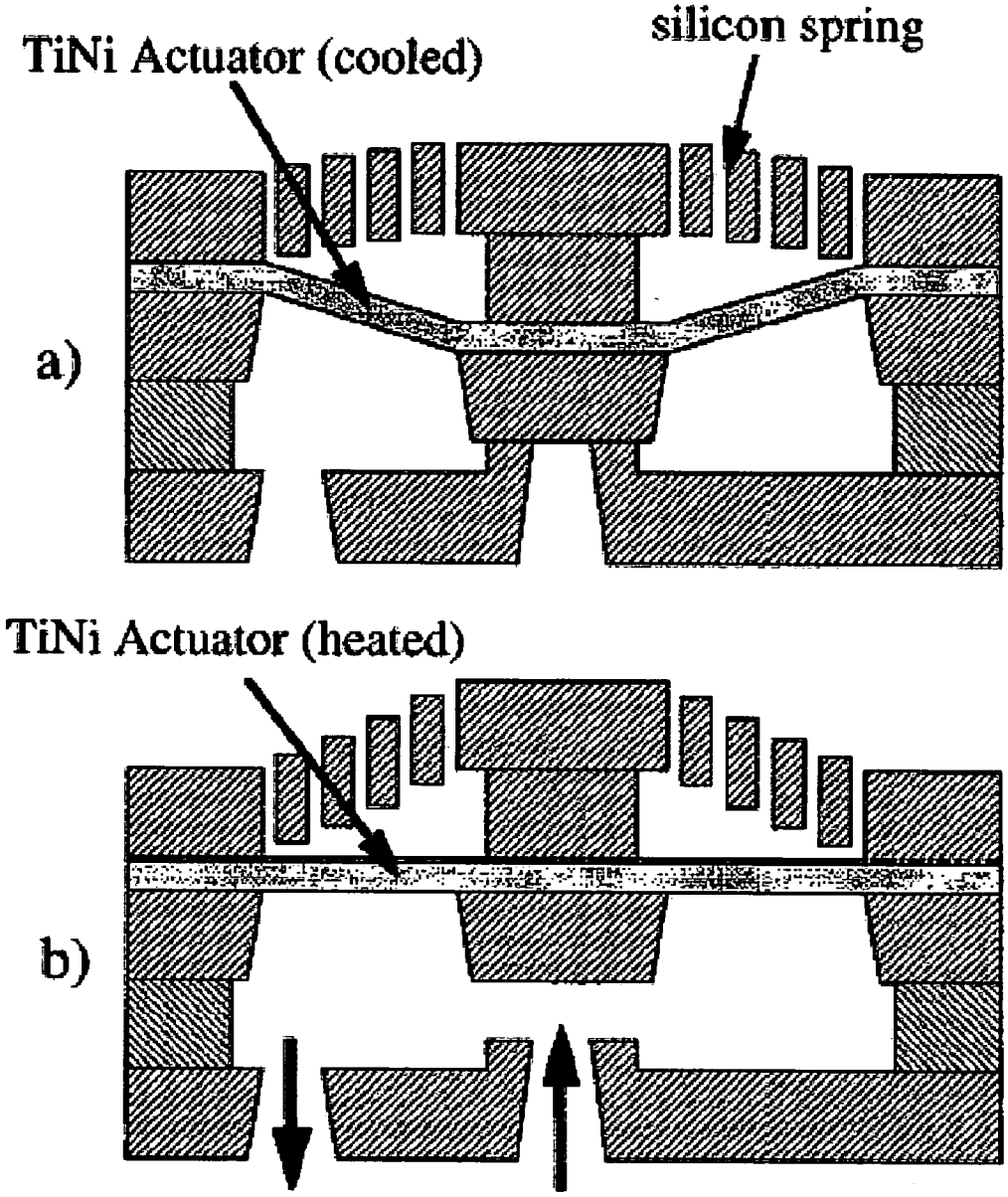
Figure 6: Microvalve using TiNi microactuators in (a) cooled and (b) heated state.

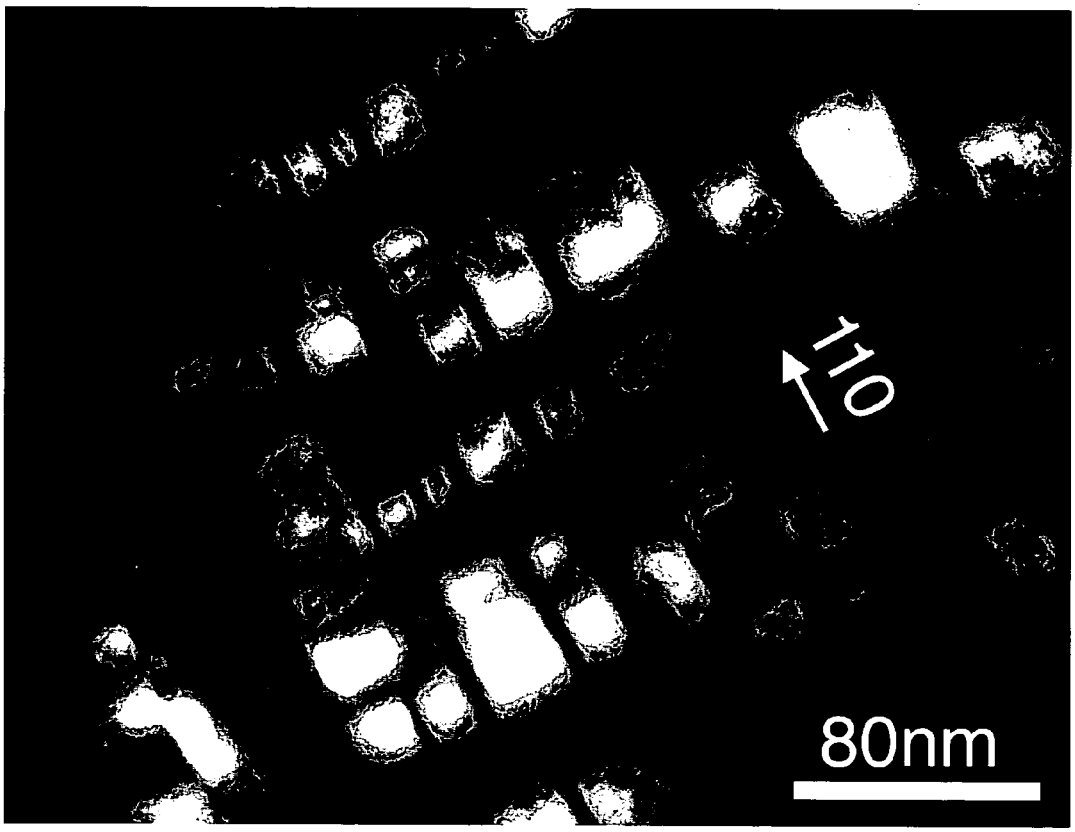
Figure 7A. TEM dark-field micrograph showing coherent nanoscale cuboidal Heusler precipitates in Ni-45Ti-5Al (in at%) aged at 600°C for 2000 h.

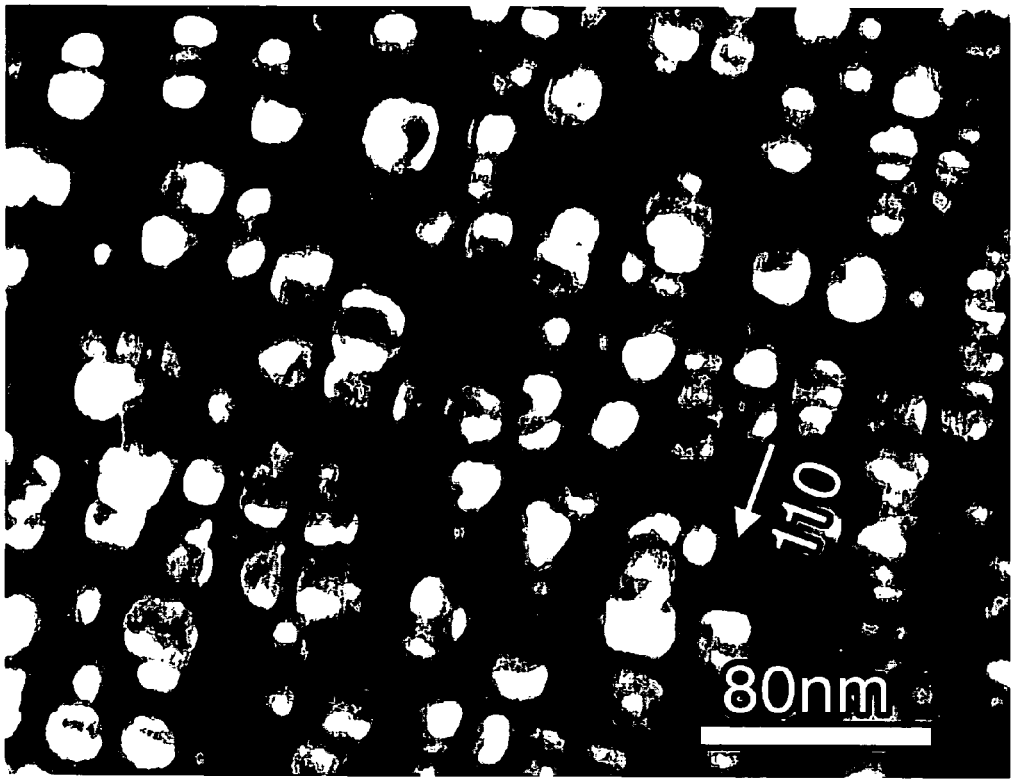
Figure 7B. TEM dark-field micrograph showing coherent nanoscale spheroidal Heusler precipitates in Ni-40Ti-5Al-5Zr (in at%) specimen aged at 600°C for 2000 h.

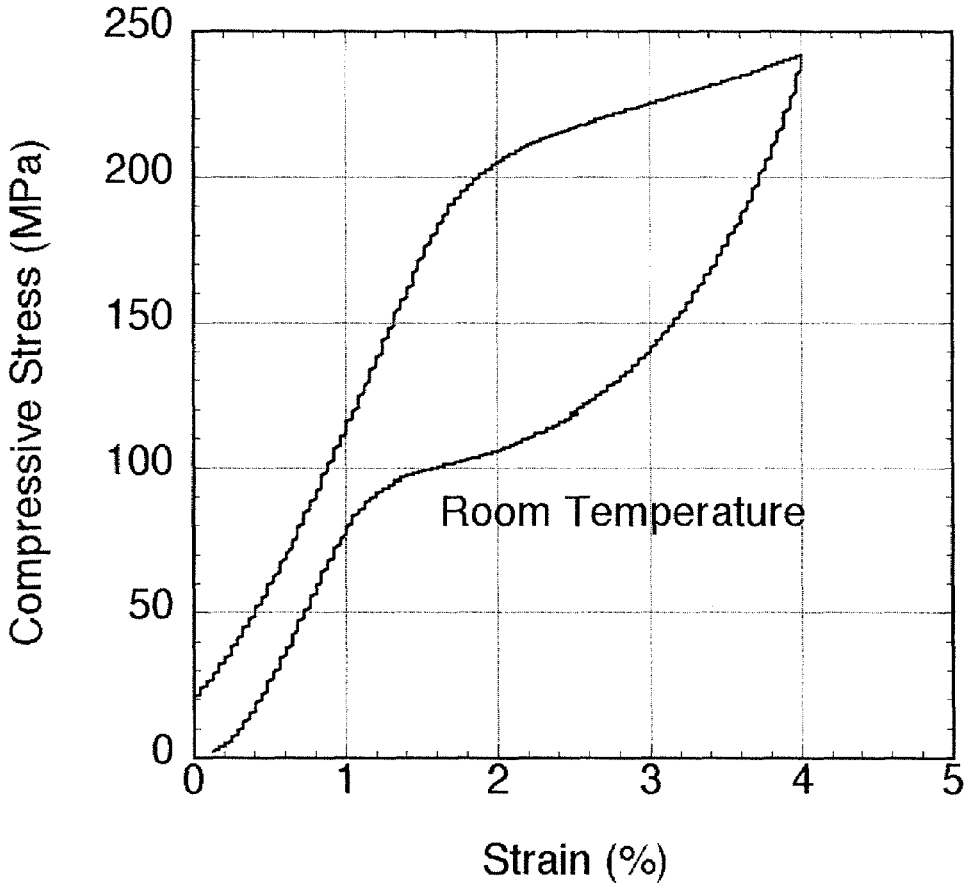
Figure 8. The compressive stress-strain response of Ni-47Ti-3Al-25Pd aged at 600°C for 100 h, tested at room temperature. Strain includes machine compliance.

COHERENT NANODISPERSION-STRENGTHENED SHAPE-MEMORY ALLOYS

CROSS REFERENCE TO RELATED APPLICATIONS

This is a utility application based upon the following provisional application which is incorporated herewith by reference and for which priority is claimed: U.S. Ser. No. 60/457,418, filed Mar. 25, 2003, entitled, "High Performance Shape Memory Alloy".

BACKGROUND OF THE INVENTION

In a principal aspect, the present invention relates to high-strength, low-hysteresis shape-memory alloys (SMAs), and in particular TiNi-based SMAs, employing coherent, low-misfit nanoscale-sized precipitates. Such alloys are contemplated to have a myriad of practical applications including, but not limited to, use in medical stents and actuators.

The shape-memory effect is a consequence of a crystallographic reversible, thermoelastic martensitic transformation. SMAs rely on property changes induced during the transformation from a high temperature phase (parent phase) to a low temperature phase (product phase or martensite); the product phase is relatively compliant in comparison with the parent phase.

Shape-memory actuation occurs when an SMA is deformed in its martensite state, below its $M_s$ temperature; the deformed shape is maintained upon unloading. Once reheated beyond the austenite finish temperature ($A_f$), an SMA will work against a resisting force to regain its original shape.

Superelasticity occurs when an SMA is deformed above austenite start temperature ($A_s$), but below $M_s^o$ (the highest temperature possible to have martensite). In this range, martensite can be made stable with the application of stress, but becomes unstable again when the stress is removed. Because of superelasticity, SMAs can deform elastically up to large strains and recover perfectly without being damaged by unloading, similar to rubber.

Under constrained conditions, the output stress of an SMA during reversion of martensitic transformation is typically limited by the flow strength of the parent phase. For engineering applications, it is also highly desirable, if not essential, that the shape-memory behavior is repeatable and predictable after many cycles through the transformation. Therefore, to improve both the output force and the cyclic lifetime of SMAs, the strength of the alloy (i.e. flow strength of parent phase) must be improved. By raising the critical shear stress for slip, the irreversible slip deformation during the martensite reorientation and stress-induced martensite transformation can be suppressed, which, in turn, improves the shape-memory effect and transformation superelasticity characteristics.

Currently, the three most commonly used SMAs in engineering applications are TiNi and the copper-based alloys, CuZnAl and CuAlNi. Several iron-based SMAs, such as FeMnSi, FePt, and FePd are also the subject matter of research for industrial applications. However, TiNi-based alloys are currently the most widely used SMAs due to good corrosion resistance and biocompatibility.

Various types of precipitate strengthening may be considered in the TiNi-based system. On the Ti-rich side of the binary Ti-Ni system, a $Ti_2Ni$ dispersion can be obtained while on the Ni-rich side $Ni_3Ti/Ni_4Ti_3$ precipitates can be considered for strengthening dispersions. Kajiwara et al. [Philos. Mag. Lett., 1996, vol. 74, pp. 137-144, J. Phys. IV, 2001, vol. 11, pp. 395-405, and Metall. Mater. Trans. A, 1997, vol. 28, pp. 1985-1991 (incorporated herewith)] found that subnanometric thin plate metastable bct precipitates formed when sputter-deposited Ti-rich TiNi shape-memory films are annealed in the temperature range of 377 to 827° C. Due to the relatively low heat treatment temperature, diffusion of Ti atoms is not rapid enough to form stable $Ti_2Ni$ precipitates; instead, Guinier-Preston zone-type precipitates which contain excess Ti atoms are produced. With these fine precipitates in the parent phase, they could achieve recovery strength 670 MPa. However, these precipitates have been observed only after annealing of sputter deposited and amorphous TiNi thin films.

While precipitation strengthening has been mainly considered in TiNi-base thin films or bulk single crystals, deformation processing has been considered in bulk polycrystalline TiNi alloys for strengthening. Lin and Wu [Acta Metall. Mater., 1994, vol. 42, pp. 1623-1630 (incorporated herewith)] studied cold-rolled equiatomic TiNi alloys. With a cold rolling at room temperature to the extent of 31% reduction in thickness, they improved the yield stress from 380 MPa of a solution treated specimen to 1000 MPa. However this is an economically inefficient approach, as the alloys have to be heat-treated following each cold rolling step.

Koizumi et al. [Mater. Sci. Engng A.: 1997, vol. 223, pp. 36-41 (incorporated herewith)] examined the high-temperature strength of TiNi alloys in the context of developing new alloys to replace Ni-base superalloys. They demonstrated that a dispersion of Heusler phase ($Ni_2TiAl$-type with $L2_1$ structure) increases the compressive yield strength of 50.7Ni-40.9Ti-8.4Al (in at %) by an order of magnitude up to 2300 MPa. This strengthening method is potentially applicable to both thin film and bulk alloy processing. While they have achieved impressive compressive yield strength in the TiNi-based alloys with Heusler precipitates, they did not consider any of the shape-memory characteristics of the alloys. Their alloys were solely developed as high-temperature materials, neglecting the thermoelastic transformations and the superelasticity.

In CuZnAl-based SMAs, a ductile second phase $\alpha$ can be distributed within the $\beta$ matrix. Compared with that of the single-phase alloy, the fatigue life of dual-phase alloys with homogeneously distributed globular $\alpha$ phase is increased in both the martensitic and superelastic state [Metall. Trans. A, 1992, vol. 23, pp. 2939-2941 (incorporated herewith)]. Semi-coherent $\gamma$ precipitates in the $\alpha$ matrix have been studied by Lovey and Cesari [Mater. Sci. Engng A.: 1990, vol. 129, pp. 127-133 (incorporated herewith)]. In CuAlNi-based SMAs, the precipitation of coherent $\gamma_2$ intermetallic compound ($Cu_9Al_4$) can be considered [J. Phys. IV, 1995, vol. 5 (C2), pp. 193-197 (incorporated herewith)]. In FeMnSi-based SMAs, the addition of small amounts of Nb and C is known to produce very small NbC carbide precipitates in austenite, which improves the shape memory effect [Scripta Mater., 2001, vol. 44, pp. 2809-2814 (incorporated herewith)]. Various phases useful for strengthening the parent phase of the matrix are summarized in TABLE 1.

TABLE 1

| SMA Parent Phase | Strengthening Phases |
|---|---|
| B2-TiNi | Metastable $Ti_2Ni$, $Ni_4Ti_3$, Stable $Ni_3Ti$, $L1_2$ ($Ni_2TiAl$) |

TABLE 1-continued

| SMA Parent Phase | Strengthening Phases |
|---|---|
| β-CuZnAl | α, γ |
| β-CuAlNi | $\gamma_2$ ($Cu_9Al_4$) |
| FeMnSi | NbC |

Nonetheless, microstructural design and the implementation in processing for improving the strength of SMAs while controlling the transformation temperatures have remained a scientific and engineering challenge. High-strength, low-hysteresis TiNi-based SMAs as well as other SMAs which achieve yield strength greater than 1200 MPa while maintaining desired transformation temperatures are much needed.

SUMMARY OF THE INVENTION

Briefly, the invention comprises high-strength, low-hysteresis SMAs and, in particular TiNi-based SMAs, employing coherent low-misfit nanoscale size precipitates, wherein the precipitate phase is based on an optimized composition for high parent-phase strength and martensite phase stability, utilizing martensite stabilizers to compensate for the stored elastic strain energy. Cycled TiNi alloys frequently exhibit decreased recovery forces and recoverable strain, all the while showing increased permanent strain and shifts in the transformation temperatures. To improve the output force and the cyclic lifetime of TiNi-based alloys, the strength of the parent phase can be significantly improved by appropriate additions of nanodispersions through alloying elements such as Al and an additive selected from the group consisting of Zr, Hf, Pd, Pt and combinations thereof.

More broadly, SMAs may achieve increased strength and thereby high output force as well as long cyclic life without irreversible effects by the addition of additives, which provide for low misfit betwen the respective phases (i.e. additives which result in coherency). Such additives preferably produce less than about 2.5% misfit in the lattice parameter.

Another feature of this invention comprises the ability to predictively control the phase transformation temperatures and to minimize hysteresis as a result of the low misfit. The additives are martensite stabilizers, which compensate for the elastic energy stored in the non-transforming, coherent, nanodispersion. While Zr is a preferred additive (along with Al) in the TiNi system, other additives such as Hf, Pd and Pt or combinations thereof are useful.

Additionally, the technique of matching phases within the parameters disclosed may be applied to other SMAs including but not limited to CuZnAl, CuZnNi, iron-based SMAs and various TiNi-based SMAs. According to known lattice constants [Pearson's Handbook of Crystallographic Data for Intermetallic Phases, ASTM International, Newbury, Ohio 1991 (incorporated herewith)], the misfit between α and β in CuZnAl-based SMAs is about 21%, misfit between γ and β is about 0.7%, and in CuAlNi-based SMAs, the misfit between $\gamma_2$ and β is about 0.9%. In FeMnSi-based SMAs, the crystal structure of NbC compound is of the NaCl type and its lattice constant is 0.4470 nm, larger by 24% than the lattice constant of the austenite (fcc) 0.3604 nm. Additives preferably produce a misfit less than the values listed above, while providing transformation temperature control.

Thus, it is an object of the invention to provide a new class of SMAs that can achieve a yield strength greater than 1200 MPa while maintaining desired transformation temperatures.

Another object of the invention is to provide high-strength, low-hysteresis SMAs employing coherent low-misfit nanoscale size precipitates wherein the interphase misfit is less than about 2.5%.

Yet another object of the invention is to provide high-strength, low-hysteresis SMAs with long-term microstructural cyclic stability, wherein the fatigue life is greater than about 10 million cycles.

Another object of the invention is to provide TiNi-based nanodispersion-strengthened alloys wherein the microstructure comprises coherent low-misfit nanoscale size precipitates.

A further object of the invention is to provide TiNi-based nanodispersion-strengthened alloys wherein the microstructure comprises coherent low-misfit multicomponent Heusler nanodispersions distributed in the parent phase.

Another object of the invention is to provide composition tolerance by incorporating a third multicomponent phase as a buffer for excess Ti in the nanodispersion-strengthened TiNi-based SMA.

A further object of the invention is to provide composition tolerance by incorporating a bcc β Nb—Ti phase as a buffer for excess Ti in the nanodispersion-strengthened TiNi-based SMA.

These and other objects, advantages and features will be set forth in the detailed description which follows.

BRIEF DESCRIPTION OF THE DRAWING

In the detailed description that follows, reference will be made to the drawings comprising the following figures:

FIG. 1 is a flow block logic diagram that characterizes the design concepts of the alloys of the invention;

FIG. 2 is an equilibrium phase diagram depicting the phases and composition at various temperatures in the pseudo-binary TiNi—NiAl system relative to the preferred embodiment and example of the invention;

FIG. 3 is a graph showing the solution temperature vs. Zr content in a preferred embodiment and example of the invention;

FIG. 4 is a graph showing the partitioning of Zr between B2-TiNi and $L2_1$-Heusler phases in a preferred embodiment and example of the invention;

FIG. 5 is a graph showing ambient interphase lattice misfit vs. Zr content in a preferred embodiment;

FIG. 6 is a schematic showing cross-sectional drawings of a TiNi-actuated microvalve in the a) closed and b) open positions, as an exemplary application of the invention;

FIG. 7A is a TEM dark-field micrograph showing coherent nanoscale cuboidal Heusler precipitates in an example of an alloy of the invention, Ni-45Ti-5Al (in at %) aged at 600° C. for 2000 h;

FIG. 7B is a TEM dark-field micrograph showing coherent nanoscale spheroidal Heusler precipitates in an example of an alloy of the invention, Ni-40Ti-5Al-5Zr (in at %) specimen aged at 600° C. for 2000 h; and FIG. 8 is a graph showing the compressive stress-strain response at room temperature of an embodiment of the invention, Ni-47Ti-3Al-25Pd (in at %) aged at 600° C. for 100 h.

DETAILED DESCRIPTION OF THE INVENTION

FIG. 1 is a systems flow-block diagram which illustrates the processing/structure/properties/performance relationships for alloys of the invention. The desired performance for the application (e.g. self-expanding stent, microactuators in microelectromechanical systems, SMA patch repair, etc.) determines a set of alloy properties required. Alloys of the invention exhibit the structural characteristics that can achieve the desired combination of properties and can be assessed through the sequential processing steps shown on the left of FIG. 1.

Employing the concepts reflected by FIG. 1, following are the criteria for the physical properties and the microstructure and composition characteristics for the alloys. This is followed by the processability characteristics of the alloys, applications, the experimental results relating to the discovery and examples of the alloys that define, in general, the range and extent of the elements, physical characteristics and processing features of the present invention.

Physical Characteristics

The physical characteristics or properties of the most preferred embodiments of the invention are generally as follows:

Strength equivalent to or better than cold-worked SMA, i.e.:

Yield Strength≧1200 MPa.

Fatigue life longer than 10 million cycles.

Optimum microstructural features for transformation temperatures and maximum output strength/fatigue resistance.

Microstructure and Composition Characteristics

The alloy designs achieve improved output force and cyclic lifetime via nanoscale, coherent, low-misfit precipitates without causing irreversible effects on the martensitic transformation. Lattice misfit arising from different lattice parameters between two coherent phases causes coherency strains with an associated volume strain energy that can act as obstacles to martensite interfacial motion, potentially increasing the transformation hysteresis ($A_f$-$M_s$). The hysteresis of the martensitic transformation determines the response rate of the final application. A quantitative theory for such behavior has been developed by Grujicic, Olson and Owen [Metall. Trans. A, 1985, vol. 16, pp. 1713-1722] which is incorporated herewith. In a system with plastically deforming precipitates, the hysteresis width will increase if these particles do not participate in the transformation. Irreversible plastic deformation of a particle will contribute to the interfacial friction stress as the interface intersects it. In NiTiNb alloys, the irreversible deformation of the Nb-rich phase delays the recovery, increasing the hysteresis. 47Ni-44Ti-9Nb (in at %) is a commercially used alloy exhibiting a wide transformation temperature hysteresis, useful for coupling and sealing. Widening of the hysteresis has also been observed in CuZnAl SMAs, where plastic accommodation occurred in y type precipitates due to matrix shape change upon transformation.

In contrast, as discovered in the subject invention, SMAs strengthened by coherent, low-misfit, nanoscale precipitates show no significant increase in transformation hysteresis, indicating no significant interfacial friction from the precipitates. The coherent, low-misfit precipitates lower the chemical equilibrium $T_0$ temperature, which is the temperature at which the parent and martensite have the same Gibbs free energy. For precipitate particles of equilibrium phases which do not transform into martensite, but are elastically sheared by the transformation, a significant amount of reversible elastic strain energy is stored. This stored energy is equivalent to further undercooling. The chemical driving force due to the undercooling is given by $\Delta G=\Delta s\ \Delta T$ where $\Delta s$ is the entropy change of the transformation per unit volume, and $\Delta T=T_0-T$ is the amount of undercooling from the chemical equilibrium temperature, $T_0$.

Another potential effect of the coherency strains is the loss of coherency of precipitates by cycling through the transformation. This has been observed in a nonthermoelastic FeNiC martensite by Chen and Winchell [Metall. Trans. A, 1980, vol. 11, pp. 1333-1339] which is incorporated herewith. Since shape-memory-based devices are typically cycled many times, to ensure long-term microstructural cyclic stability, the interphase misfit has to be reduced. Thus, a feature of the alloys of the invention is minimization of the interphase lattice mismatch to promote fine scale homogeneous precipitation.

The strength of an overaged material is inversely proportional to an average particle spacing, or it scales with $\sqrt{f/r}$ where f is the phase fraction and r is the particle size. Therefore for a given phase fraction, the finest and closely spaced dispersion of strengthening particles is desired. This can be achieved by increasing the thermodynamic driving force for nucleation, which, in turn, is achieved by increasing the supersaturation or reducing the lattice misfit.

The precipitation of equilibrium Heusler ($Ni_2TiAl$-type with $L2_1$ structure) phase in TiNi is useful to satisfy the design criteria and therefore is considered as a preferred embodiment of the subject invention. There is a lattice misfit between TiNi and $Ni_2TiAl$, as determined by the relation $$\delta = \left(\frac{a_{Ni_2TiAl} - 2a_{TiNi}}{2a_{TiNi}}\right) = -0.0257$$

where $\alpha_{Ni_2TiAl}$ is the ambient lattice parameter of $Ni_2TiAl$ (a=0.5865 nm) and $\alpha_{TiNi}$ is the ambient lattice parameter of TiNi (a=0.3010 nm). The misfit decreases at elevated temperatures due to a combined effect of solute solubility limit and thermal expansions, and therefore about 2.5% is the upper limit for a tolerable misfit in the subject invention. The lowest possible misfit between B2 and $L2_1$ phases can be achieved by increasing the lattice parameter of the multi-component Heusler phase through alloying elements such as Hf or Zr substituting on the Ti sublattice, and Pd or Pt substituting on the Ni sublattice in the alloy.

Al added to form the Heusler phase has significant solubility in the B2 matrix. Al dissolved in the matrix also decreases the transformation temperatures drastically. While transformation temperatures are relatively insensitive to the Ni/Ti ratio in the Ti-rich regime, they show a strong decrease in the Ni-rich regime. Since Al is substituting in the Ti sublattices, the transformation temperature is affected both by the overall atomic percentage of Al as well as the adjusted Ni/Ti ratio. Because of the strong decrease of transformation temperatures by Al in B2, elements which can stabilize the martensite phase and thereby offset the B2 stabilizing effect of soluble Al are added. Accordingly Hf, Zr, Pd, and Pt, initially considered for reducing the lattice misfit between B2 and $L2_1$ phase, are also martensite stabilizers. Their addition allows a higher transformation temperature. If Hf, Zr, Pd, and Pt partition to B2, the stability of martensite phase will be increased, and if they partition of $L2_1$, the interphase lattice misfit will be reduced.

For comparison, in both CuZnAl and CuAlNi-based systems, the stability of β' martensite decreases with Al, Zn, and Ni content. The martensitic transformation temperature is very sensitive to small variations in alloy composition. Although the transformation temperatures of both CuZnAl and CuAlNi alloys can be manipulated over a wide range, the practical upper limits are 120° C. and 200° C. respectively, above these temperatures the transformations tend to be unstable. FeMnSi based alloys are one-way shape memory materials with high strength, high action temperatures, good workability and low cost. Addition of nitrogen or rare earth elements lowers the $M_s$ temperature, stabilizing the austenite after shape recovery.

In TiNi-based SMAs, oxides such as $Ti_4Ni_2O$ or $Y_2O_3$ can form during the arc-melting or powder consolidation process; however such dispersions may be desirable because of their grain refining effect. Typical TiNi contains oxygen concentrations of 350 to 500 ppm and carbon from 100 to 500 ppm depending on starting materials and melt practice. $Ti_4Ni_2O$ type oxides effectively pin the grain boundaries during the dynamic recrystallization occurring with the hot-working process. To improve the ductility of the material the grain size has to be reduced, and for this purpose B is preferably added to form borides. Yang and Mikkola [Scripta Metall. Mater., 1993, vol. 28, pp. 161-165 (incorporated herewith)], confirmed improved ductility by the addition of 0.12 at % boron in TiNiPd alloys.

Another feature of the alloys is built-in tolerance for composition variation to ensure a robust design. The composition range of the B2-TiNi phase is narrow even at high temperatures. Therefore, strict composition control in alloy production would be required to avoid precipitation of $Ni_3Ti$, $Ni_4Ti_3$, $Ni_3Ti_2$, or $Ti_2Ni$ that are harmful to ductility. To promote robust alloy production, the composition tolerance in manufacturing will have to be increased. Ni-rich compositions are avoided because the martensitic transformation temperatures dramatically decrease. By incorporating a third multicomponent phase as a buffer for excess Ti in the nanodispersion-strengthened TiNi-based SMA, tolerance for composition variance can be built in. For example, the bcc β Nb—Ti phase can be incorporated as a buffer for excess Ti in alloy compositions that are deliberately kept Ni-lean to avoid the competing Ni-rich phases. Variations in excess Ti would be absorbed in small composition variations in the Nb-based buffer phase, which is kept at a sufficiently low phase fraction not to degrade mechanical properties and transformation hysteresis. To prevent increasing of the hysteresis, as seen in the commercially used NiTiNb alloys, Nb will have to be kept lower than about 9 at %.

Processability Characteristics

A principal goal of the subject invention is to provide alloys with the objective physical properties and microstructural characteristics recited above and with processability that renders the alloys useful and practical. With a number of possible processing paths associated with the scale of manufacture and the resulting cleanliness and quality for a given application, compatibility of the alloys of the subject invention with a wide range of processes is desirable and is thus a feature of the invention.

A primary objective and characteristic of the alloys is compatibility with melting practices such as Vacuum Induction Melting (VIM) and Vacuum Arc Remelting (VAR), and other variants such as Vacuum Induction Skull Melting process. Alloys of the subject invention can also be produced by other processes such as powder consolidation. By selection of appropriate elemental content in the alloys of the subject invention, the variation of composition can be minimized.

Allowable variation results in an alloy that can be homogenized at commercially feasible temperatures, usually at metal temperatures in excess of 900° C. Objectives regarding solution heat treatment include the goal to fully homogenize the alloy while maintaining a fine scale grain refining dispersion (i.e. $Ti_4Ni_2O$, $Y_2O_3$) and a small grain size. The solution temperature of binary TiNi shape memory alloy is generally limited by the order-disorder transition temperature at 1090° C. With an initial target solution temperature of 900° C., the Al content of the matrix can be designed utilizing a pseudo-binary phase diagram, FIG. 2, of TiNi to NiAl. This is created using the thermodynamic calculation software Thermo-Calc [Calphad, 1978, vol. 2, pp. 227-238 (incorporated herewith)] and a custom thermodynamic database, which is based on a thermodynamic assessment in the Ti—Ni—Al system undertaken in collaboration with Dr. Weiming Huang at QuesTek Innovations, LLC [Jung, J. Doctoral Thesis, Department of Materials Science and Engineering, Northwestern University, Evanston, Ill., 2003 (incorporated herewith)]. This could also be constructed empirically by a person skilled in the art. From this, the solubility of aluminum at 900° C. can be determined as about 6 at %.

In a preferred embodiment, a Zr addition to the TiNi-Heusler system is considered because Zr has the most significant effect on decreasing the lattice misfit while efficiently raising the martensite stability. Adding small amounts of Zr increases the solution temperature as seen in FIG. 3, which is again calculated using the custom database (referenced above) with Thermo-Calc. This could also be assessed empirically by a person skilled in the art. Since Zr quickly increases the solution temperature, it was determined the Al level should preferably be lower than about 4 at %.

Due to the solution hardening of solute atoms in the TiNi B2 matrix, the alloys are stronger than binary TiNi even before the strengthening phase precipitation. This can make manufacturing and machining difficult, since for these operations a soft material which exhibits favorable chip formation is desired. Therefore alloys of the subject invention are preferably annealed to reduce the hardness before they are supplied to a manufacturer. Typically this pretreatment would be accomplished by heating the alloy at about 800° C., for a period of less than one thousand hours, preferably between one and one hundred hours and cooling to room temperature. In some cases a multiple-step annealing process may provide more optimal result. In such a process an alloy of the invention may be annealed at a series of temperatures for various times that may or may not be separated by an intermediate cooling step or steps. Through this pretreatment, alloys would be over-aged to coarsen precipitates and reduce the alloying elements in the B2 matrix, thereby minimizing solid solution strengthening. Components made of alloys of the subject invention can be manufactured or machined after this pretreatment, and the components will be ultimately given a final solutionizing and aging treatment to attain full hardening.

The temperature of the final aging process would typically be between 600° C. and 800° C., at a temperature where the lowest possible misfit can be achieved by increasing the lattice parameter of the multicomponent Heusler phase. To realize this design concept, a combination of Analytical Electron Microscopy and 3-Dimensional Atom Probe microanalysis was conducted by Jung et al. [Metall. Mater. Trans., 2003, vol. 34, pp. 1221-1235 (incorporated herewith)] and the interphase partitioning at 600° C. and 800° C. were established. The $B2/L2_1$ solute partitioning is discovered to be strongly temperature dependent and can reverse direction between 600° C. and 800° C. By incorporating these measurements into a solution thermodynamic assessment for the Ti—Ni—Al—Zr system, the composition dependence of the solute partitioning can be predicted, and a model for the composition and temperature dependence of the B2 and $L2_1$ lattice parameters has been developed to predictively control interphase misfit at precipitation and use temperatures.

For the temperature dependent partitioning of Zr, FIG. 4 can be generated. The partition coefficient of Zr shows a smooth composition dependence, in addition to the temperature dependence. In these calculations the Al content of the alloy was kept at about 5 at %. The solute partitioning of Zr is discovered to be in favor of reducing the interphase misfit at 600° C. Therefore the modeling efforts are focused at 600° C., and better agreement is obtained at this temperature. More Zr enters the Heusler phase at low Zr contents at 600° C. Using models for the composition and temperature dependence of the B2-TiNi and $L2_1$-Heusler phase lattice parameters, the misfit of the B2 and Heusler phases at 600° C. can be plotted as a function of Zr content, in the alloy, as seen in FIG. 5. Thus the temperature of the final aging process would preferably be from 600° C. to 650° C. and less than hundred hours in duration, preferably between one and twenty hours. The outcome of the desired process is a B2 matrix strengthened by a fully-coherent low-misfit nanoscale dispersion which is aged at a minimum predetermined temperature for a minimum time to achieve workability.

Applications

Among many, a few applications could be considered to test the limits of the conceptual design capability for coherent nanodispersion-strengthened shape-memory alloys.

Medical applications such as self-expanding stents utilize the superelasticity of TiNi-based SMAs, for which the To will have to be placed below body temperature. The biased stiffness of TiNi causes the stent to passively press against the vessel in a very compliant fashion, yet the stent resists constriction with a comparatively high stiffness. Physicians can oversize the stent to the vessel, and feel confident that while the stent is stiff enough to scaffold the vessel, the passive forces will not be so great as to perforate the vessel wall. To improve the cyclic lifetime of TiNi, the strength of the alloy parent phase must be improved to eliminate accommodation slip during transformation, which can be achieved through the subject invention.

Recently, the demand for powerful microactuators in microelectromechanical systems (MEMS) has motivated significant SMA thin film research. This is because SMAs produce actuation forces and strokes superior to other actuator materials. As seen in FIG. 6, in the off/unpowered position the microspring deflects the martensitic TiNi film downward, pressing the boss against the orifice opening. When heated, the austenitic TiNi becomes nearly flat, deflecting the microspring upward, lifting the boss away from the orifice and allowing fluid to flow. Traditional SMA microactuators used in MEMS devices suffer from limited cyclic life due to accommodation slip. To improve the output force and the cyclic lifetime of TiNi-based alloys, the strength of the alloy must be improved.

Shape-memory actuators are becoming increasingly popular for automotive applications. In a modem car more than 100 actuators are used to control engine, transmission and suspension performance, to improve safety and reliability and enhance driver comfort. The operating temperature range of a car ranges from −40° C. to approximately +100° C., with even higher temperatures in under-hood locations. In order to work properly at all temperatures, the shape memory alloy has to have an $M_f$ temperature well above the maximum operating temperature.

A novel technique can be developed based on the subject invention that applies a self-repair patch across cracked weld joints so that catastrophic fatigue failures could be prevented. Welded structures that are subjected to cyclic loading often fail by fatigue at the weld joint. This can lead to the structure eventually breaking or becoming non-functional. In either case the cost associated with the fatigue failure can be significant. Repair of cracked or aging structures with bonded composite patches has shown great promise to become a viable method for life extension of such structures. This process relies on the principle of crack-closure phenomenon where the opening stress on the crack faces is reduced by placing a patch across the wake of the crack. However these patch designs merely act as a band-aid to hinder future crack growth. The shape memory mechanism of TiNi-based alloys can be utilized to bear loads and apply compressive stress to the crack. A pre-deformed shape memory alloy patch can be heated above the austenite finish temperature and the patch will apply crack closure clamping force by reverting to its memorized shape.

Tailored to the applications as described above, the $T_0$ temperature can be calculated and alloy compositions can be designed accordingly taking into account the effect of stored elastic energy of precipitates.

EXPERIMENTAL RESULTS AND EXAMPLES

A series of prototype alloys were prepared. Sample buttons or slugs of prototype alloys weighing 25 g were prepared by arc-melting in an argon atmosphere using pure elements (99.99~99.994 wt % Ni, 99.99 wt % Ti, 99.999 wt % Al, 99.9 wt % Hf, 99.98 wt % Pd, 99.95 wt % Pt, and 99.999 wt % Zr). Taking equiatomic TiNi as reference, in alloys A, A+5Hf and A+5Zr the Ni-content was kept at 50 at % while Ti was partially replaced by Al, Hf or Zr. On the other hand, in alloys B+5Pd, B+20Pd and B+5Pt, Ni was partially substituted by Pd and Pt. Alloys with high Pd-content Ni-49Ti-1Al-25Pd (D+1Al) and Ni-47Ti-3Al-25Pd (D+3Al) were also designed. A prototype alloy of composition Ni-32Ti-3Al-15Zr (E+15Zr) was investigated. The compositions of the prototypes are given in TABLE 2.

TABLE 2

| Alloy | Ni | Ti | Al | Hf | Zr | Pd | Pt |
|---|---|---|---|---|---|---|---|
| A | 50 | 45 | 5 | — | — | — | — |
| A + 5Hf | 50 | 40 | 5 | 5 | — | — | — |
| A + 5Zr | 50 | 40 | 5 | — | 5 | — | — |
| B + 5Pd | 45 | 44 | 6 | — | — | 5 | — |
| B + 20Pd | 30 | 44 | 6 | — | — | 20 | — |
| B + 5Pt | 45 | 44 | 6 | — | — | — | 5 |
| D + 1Al | 25 | 49 | 1 | — | — | 25 | — |
| D + 3Al | 25 | 47 | 3 | — | — | 25 | — |
| E + 15Zr | 50 | 32 | 3 | — | 15 | — | — |

Note:
All values in at %

Consistent with model predictions, A+5Zr prototype alloy demonstrates near-zero misfit at 600° C. As this alloy was designed to stabilize B2 against martensitic transformation, the martensitic transformation temperature was too low (<−150° C.) to be detected. The Al retained in the B2 matrix decreases the transformation temperature, while the martensite stabilizer Zr was present only in a limited amount.

To study the multicomponent effect on $T_0$, transformable alloys with high Pd-content D+1Al, D+3Al, and high Zrcontent E+15Zr were designed. All three second-iteration prototypes gave satisfactory transformation temperatures. The best mechanical properties of the second iteration were exhibited by alloy E+15Zr, which demonstrates a recovery stress of 2100 MPa at 180° C., in combination with a high $A_f$ reversion temperature of 149° C.

Following is a summary of the described experiments and alloys:

Example 1

As-cast specimen of alloy A in TABLE 2 was sealed in an evacuated quartz capsule and solution treated at 1100° C. for 100 h. After quenching by crushing the capsules in oil, it was annealed at 800° C. for 1000 h or 600° C. for 1000 or 2000 h in evacuated quartz capsules, and then quenched into oil. FIG. 7A shows coherent nanoscale cuboidal Heusler precipitates in alloy A aged at 600° C. for 2000 h.

The ambient lattice parameters obtained from the X-ray diffraction experiments, corrected for instrumental factors, are listed in TABLE 3 together with Vickers hardness numbers. Originally intended for the phase-relations study, this alloy was over-aged to yield large Heusler precipitates. Therefore the effect of precipitation strengthening is minimized and the hardness numbers mainly reflect the solution strengthening contribution.

As this alloy was designed to stabilize B2 against martensitic transformation, the martensitic transformation temperatures were too low (<−150° C.) to be detected. Hot hardness measurements were carried out on the aged A alloys using a custom tester. Both A alloys aged at 800° C. and 600° C. exhibit a monotonic decrease of hardness over the temperature. This indicates that the formation of stress-induced martensite is suppressed and the room temperature hardness measurements reflect the strength of the parent phase, i.e. $M_s^o$<room temperature.

TABLE 3

Various measured properties for Alloy A

| Property | Solution Treated | Aged at 800° C. | Aged at 600° C. |
|---|---|---|---|
| Lattice Parameter | 0.30018 nm (B2) | 0.30022 nm (B2)<br>0.59068 nm (Heusler) | 0.30132 nm (B2)<br>0.59358 nm (Heusler) |
| Vickers Hardness Number | 349 | 463 | 430 |

Example 2

As-cast specimen of alloy A+Hf in TABLE 2 was sealed in an evacuated quartz capsule and solution treated at 1100° C. for 100 h. After quenching by crushing the capsules in oil, it was annealed at 800° C. for 1000 h or 600° C. for 1000 or 2000 h in evacuated quartz capsules, and then quenched into oil.

The ambient lattice parameters obtained from the X-ray diffraction experiments, corrected for instrumental factors, are listed in TABLE 4. Substitution of Ti by Hf leads to an increase in lattice parameter of the quaternary alloys, compared to alloy A. Vickers hardness numbers for A+Hf aged at 800° C. or 600° C. for 1000 h are also shown in TABLE 4. Originally intended for the phase-relations study, this alloy was over-aged to yield large Heusler precipitates. Therefore the effect of precipitation strengthening is minimized and the hardness numbers mainly reflect the solution strengthening contribution. As this alloy was designed to stabilize B2 against martensitic transformation, the martensitic transformation temperatures were too low (<−150° C.) to be detected.

TABLE 4

Various measured properties for Alloy A + 5Hf

| Property | Solution Treated | Aged at 800° C. | Aged at 600° C. |
|---|---|---|---|
| Lattice Parameter | 0.30331 nm (B2) | 0.30298 nm (B2)<br>0.59410 nm (Heusler) | 0.30171 nm (B2)<br>0.59518 nm (Heusler) |
| Vickers Hardness Number | — | 491 | 489 |

Example 3

As-cast specimen of alloy A+Zr in TABLE 2 was sealed in an evacuated quartz capsule and solution treated at 1100° C. for 100 h. After quenching by crushing the capsules in oil, it was annealed at 800° C. for 1000 h or 600° C. for 1000 or 2000 h in evacuated quartz capsules, and then quenched into oil.

The ambient lattice parameters obtained from the X-ray diffraction experiments, corrected for instrumental factors, are listed in TABLE 5. Substitution of Ti by Zr leads to an increase in lattice parameter of the quaternary alloys, compared to alloy A. A+5Zr demonstrates near-zero misfit at 600° C. This is consistent with the Heusler particle morphology transition to a spheroidal form, as shown in FIG. 7B.

Vickers hardness numbers for A+Zr aged at 800° C. or 600° C. for 1000 h are shown in TABLE 5. Originally intended for the phase-relations study, this alloy was over-aged to yield large Heusler precipitates. Therefore the effect of precipitation strengthening is minimized and the hardness numbers mainly reflect the solution strengthening contribution. As this alloy was designed to stabilize B2 against martensitic transformation, the martensitic transformation temperatures were too low (<−150° C.) to be detected.

TABLE 5

Various measured properties for Alloy A + 5Zr

| Property | Solution Treated | Aged at 800° C. | Aged at 600° C. |
|---|---|---|---|
| Lattice Parameter | 0.30543 nm (B2) | 0.30468 nm (B2)<br>0.59851 nm (Heusler) | 0.30255 nm (B2)<br>0.60351 nm (Heusler) |
| Vickers Hardness Number | 503 | 522 | 491 |

As the A+5Zr prototype showed promising interphase misfit levels, the precipitation strengthening was investigated in detail. A+5Zr was aged at 600° C. for 1,3,10, and 100 h and Vickers hardness was measured as a function of aging time. The measured properties are listed in TABLE 6. The average equivalent spherical radius of the precipitates was determined based on conventional transmission electron microscopy measurements. Peak hardening is in the range from 1 to 10 h of aging at 600° C., which corresponds to a precipitate radius of 1.44 to 2.45 nm.

TABLE 6

| Vickers hardness number of A + 5Zr aged at 600° C. | | |
|---|---|---|
| Aging Time | Precipitate Radius | Vickers Hardness |
| Solution | — | 503 |
| 1 hour | 1.44 nm | 516 |
| 3 hours | 1.86 nm | 553 |
| 10 hours | 2.45 nm | 531 |
| 100 hours | 4.37 nm | 531 |
| 1000 hours | 5.65 nm | 491 |
| 2000 hours | 9.94 nm | 404 |

Example 4

As-cast specimen of alloy B+5Pd in TABLE 2 was sealed in an evacuated quartz capsule and solution treated at 1100° C. for 100 h. After quenching by crushing the capsules in oil, it was annealed at 800° C. or 600° C. for 100 h in evacuated quartz capsules, and then quenched into oil.

The ambient lattice parameters obtained from the X-ray diffraction experiments, corrected for instrumental factors, are listed in TABLE 7. Substitution of Ni by Pd leads to an increase in lattice parameter of the quaternary alloys, compared to alloy A. As this alloy was designed to stabilize B2 against martensitic transformation, the martensitic transformation temperatures were too low (<−150° C.) to be detected.

TABLE 7

| Lattice Parameter for Alloy B + 5Pd | |
|---|---|
| Heat Treatment | Lattice Parameter |
| Aged at 800° C. | 0.30360 nm (B2)<br>0.60175 nm (Heusler) |
| Aged at 600° C. | 0.30276 nm (B2)<br>0.59818 nm (Heusler) |

Example 5

As-cast specimen of alloy B+20Pd in TABLE 2 was sealed in an evacuated quartz capsule and solution treated at 1100° C. for 100 h. After quenching by crushing the capsules in oil, it was annealed at 800° C. or 600° C. for 100 h in evacuated quartz capsules, and then quenched into oil.

The ambient lattice parameters obtained from the X-ray diffraction experiments, corrected for instrumental factors, are listed in TABLE 8. Substitution of Ni by Pd leads to an increase in lattice parameter of the quaternary alloys, compared to alloy A. As this alloy was designed to stabilize B2 against martensitic transformation, the martensitic transformation temperatures were too low (<−150° C.) to be detected.

TABLE 8

| Lattice Parameter for Alloy B + 20Pd | |
|---|---|
| Heat Treatment | Lattice Parameter |
| Aged at 800° C. | 0.30612 nm (B2)<br>0.61031 nm (Heusler) |
| Aged at 600° C. | 0.30579 nm (B2)<br>0.60397 nm (Heusler) |

Example 6

As-cast specimen of alloy B+5Pt in TABLE 2 was sealed in an evacuated quartz capsule and solution treated at 1100° C. for 100 h. After quenching by crushing the capsules in oil, it was annealed at 800° C. or 600° C. for 100 h in evacuated quartz capsules, and then quenched into oil.

The ambient lattice parameters obtained from the X-ray diffraction experiments, corrected for instrumental factors, are listed in TABLE 9. Substitution of Ni by Pt leads to an increase in lattice parameter of the quaternary alloys, compared to alloy A. As this alloy was designed to stabilize B2 against martensitic transformation, the martensitic transformation temperatures were too low (<−150° C.) to be detected.

TABLE 9

| Lattice Parameter for Alloy B + 5Pt | |
|---|---|
| Heat Treatment | Lattice Parameter |
| Solution Treated | 0.30059 nm (B2) |
| Aged at 800° C. | 0.30612 nm (B2)<br>0.61031 nm (Heusler) |
| Aged at 600° C. | 0.30579 nm (B2)<br>0.60397 nm (Heusler) |

Example 7

As-cast specimen of alloy D+1Al in TABLE 2 was sealed in an evacuated quartz capsule and solution treated at 950° C. for 100 h. A low solutionizing temperature was chosen to minimize the possible nucleation and growth of $Ti_2Ni$-based particles. This alloy was designed to study the multicomponent effect on $T_0$ in a single phase material, and therefore was not aged. The $A_s$, $A_f$, $M_s$, and $M_f$ temperatures were determined by Differential Scanning Calorimetry (DSC). These are summarized in TABLE 10.

TABLE 10

| Martensitic Transformation Temperatures for Alloy D + 1Al | |
|---|---|
| $M_s$ | 135° C. |
| $M_f$ | 119° C. |
| $A_s$ | 130° C. |
| $A_f$ | 145° C. |
| Hysteresis ($A_f - M_s$) | 10° C. |

Example 8

As-cast specimen of alloy D+3Al in TABLE 2 was sealed in an evacuated quartz capsule and solution treated at 950° C. for 100 h. A low solutionizing temperature was chosen to minimize the possible nucleation and growth of $Ti_2Ni$-based particles. After quenching by crushing the capsules in oil, it was annealed at 600° C. for 100 h in evacuated quartz capsules, and then quenched into oil. The $A_s$, $A_f$, $M_s$, and $M_f$ temperatures were determined by Differential Scanning Calorimetry (DSC). These are summarized in TABLE 11. The large decrease in transformation temperatures, and increased hysteresis compared to D+1Al indicate the effects of Al. Based on the solubility limit of Al in TiNi at 600° C., D+3Al should yield 2.4% Heusler phase by volume.

TABLE 11

| Martensitic Transformation Temperatures for Alloy D + 3Al | | |
|---|---|---|
| | Solutionized | Aged |
| $M_s$ | −34° C. | −23° C. |
| $M_f$ | −86° C. | −37° C. |
| $A_s$ | −47° C. | −21° C. |
| $A_f$ | −10° C. | −2° C. |
| Hysteresis ($A_f - M_s$) | 24° C. | 21° C. |

Compression tests specimens of 3 (diameter)×5 (height) mm were produced by EDM machining. The aged D+3Al shows a superelastic behavior, at the stress level up to 700 MPa, as shown in FIG. 8. D+3Al aged at 600° C. exhibits a strength level comparable to precipitation strengthened binary TiNi alloys, which is encouraging considering the Heusler phase fraction is only 2.4%.

Example 9

As-cast specimen of alloy E+15Zr in TABLE 2 was sealed in an evacuated quartz capsule and solution treated at 950° C. for 100 h. A low solutionizing temperature was chosen to minimize the possible nucleation and growth of $Ti_2Ni$-based particles. After quenching by crushing the capsules in oil, it was annealed at 600° C. for 100 h in evacuated quartz capsules, and then quenched into oil. The $A_s$, $A_f$, $M_s$, and $M_f$ temperatures were determined by Differential Scanning Calorimetry (DSC). These are summarized in TABLE 12. The dispersion-strengthened E+15Zr shows no significant increase in transformation hysteresis, indicating no significant interfacial friction from the precipitates.

TABLE 12

| Martensitic Transformation Temperatures for Alloy E + 15Zr | | |
|---|---|---|
| | Solutionized | Aged |
| $M_s$ | 137° C. | 143° C. |
| $M_f$ | 104° C. | 112° C. |
| $A_s$ | 127° C. | 128° C. |
| $A_f$ | 142° C. | 149° C. |
| Hysteresis ($A_f - M_s$) | 5° C. | 6° C. |

Compression tests specimens of 3 (diameter)×5 (height) mm were produced by EDM machining. Aged E+15Zr specimens were compressed above $A_f$ at 180° C. and 155° C. For the first specimen tested at 180° C., yield was around 2100 MPa and fracture occurred at 2200 MPa. After observing the fracture, another sample was tested at the same temperature, to check the reproducibility of the test. Superelastic behavior was observed at a stress level up to 1400 MPa. This is a very high stress level, especially considering a small predicted Heusler phase fraction. Based on a calculated thermodynamic equilibrium, the volume fraction of $L2_1$ phase is 11.1%. The measured properties are listed in TABLE 13.

TABLE 13

| Compression Test Results for Alloy E + 15Zr aged at 600° C. | |
|---|---|
| Property | Value |
| Yield Strength | 1099 MPa at 155° C. |
| Fracture Stress | 2100 MPa at 180° C. |
| | 2200 MPa at 180° C. |

As a consequence of such research and examples, the alloys in the preferred embodiment of the subject invention are considered to have a range of combinations of elements as set forth in TABLE 14.

TABLE 14

| Alloy Sub-class | Ti | Al | Hf | Zr | Pd | Pt |
|---|---|---|---|---|---|---|
| 1 | 32 to 40 | 3 to 4 | — | 8 to 15 | — | — |
| 2 | 30 to 40 | 3 to 4 | 9 to 17 | — | — | — |
| 2 | About 47 | About 3 | — | — | 5 to 20 | — |
| 3 | About 47 | About 3 | — | — | — | 5 to 20 |

All values in at %

| With one or more of: | | | |
|---|---|---|---|
| Nb | B | O | C |
| <9 | <0.1 | <500 ppm | <500 ppm |

And the balance Ni

Preferably, impurities are avoided; however, some impurities and incidental elements are tolerated and within the scope of the invention. Thus, by weight, most preferably, O is less than about 0.05% and C less than about 0.05%. Ni-rich compositions should be avoided to prevent the formation of metastable phases such as $Ni_3Ti_2$ or $Ni_4Ti_3$. In the Ni-lean region the low-melting Laves phase should be avoided. To achieve this, the sum of Ti, Al, Hf, and Zr, and the sum of Ni, Pd, and Pt, are preferably kept at about 50 at %.

The TiNi-based alloys comprise a structure of multicomponent Heusler phase nanodispersions distributed in the parent phase, wherein the Heusler phase is based on an optimized composition for high parent-phase strength and martensite phase stability, and compensating the stored elastic energy by the addition of martensite stabilizers. The alloy composition allows for slight composition variations that may arise during processing, by incorporating a bcc Nb—Ti phase as a buffer for excess Ti in alloy compositions.

This alloy will have to be solutionized at a temperature higher than 890° C. and subsequently annealed at about 800° C. between one and one hundred hours to reduce the hardness before they are supplied to a manufacturer. After this pretreatment, the components will be ultimately given a final solutionizing and aging treatment to attain full hardening. Final aging treatment will be at about 600° C. for 20 h or at about 650° C. for a shorter time, for peak strength. This design is robust for aging, because the size evolution of $L2_1$ precipitates is relatively slow.

The specific alloy compositions of TABLE 14 represent the presently known preferred and optimal formulations in this class of alloys, it being understood that variations of formulations consistent with the physical properties described, the processing steps and within the ranges disclosed as well as equivalents are within the scope of the invention. Subclass 1 is similar in composition to alloys A, A+5Zr, and E+15Zr of TABLE 2 and is optimal for reducing the lattice misfit while stabilizing the martensite phase. Subclass 2 is similar in composition to alloy A+5Hf, and is optimal for reducing the lattice misfit while stabilizing the martensite phase. Subclasses 3 and 4 are similar in composition to alloys B+5Pd, B+20Pd, B+5Pt, D+1Al, and D+3Al of TABLE 2 and are optimal for superelastic applications.

The subject invention can be extended to other systems of SMAs, including copper-based alloys CuZnAl, CuAlNi, and iron-based SMAs such as FeMnSi. In CuZnAl-based SMAs, the additive will have to optimize the strength and phase stability of the β parent phase by reducing the misfit between the parent and strengthening phases such α or γ, while compensating for the stored elastic energy. In CuAlNi-based SMAs, $\gamma_2$ intermetallic compound ($Cu_9Al_4$) can be considered as a strengthening phase. In FeMnSi-based SMAs, strengthening particles such as NbC carbides will have to be coherently precipitated in a nanoscale-size while maintaining desired transformation temperatures.

While examples of the alloys of the invention, their processing, manufacture and use have been set forth, multiple variations of such SMAs are considered to be within the scope of the invention. Therefore, the invention including the class of coherent nanodispersion-strengthened SMAs and the processes for making and using such alloys is to be limited only by the following claims and equivalents thereof.

What is claimed is:

1. A shape memory alloy comprising, in combination:

a temperature sensitive alloy characterized by a displacive transformation between a first parent phase and a second product phase, said first parent phase maintaining a deformed shape below the $M_s$ temperature following stress and unloading and transformable to an original shape upon reheating above an $A_f$ temperature;

said alloy further characterized by a coherent, nanodispersion of an additional phase providing a misfit of less than about 2.5% in the lattice structure between the nanodispersion and the parent phase;

said alloy comprising titanium, nickel, aluminum and one or more additive materials selected from the group consisting of hafnium, zirconium, palladium, and platinum, said alloy comprising a Heusler phase nanodispersion distributed in a B2 parent phase.

2. The alloy of claim 1 comprising in atomic percent about 32 to 40 percent titanium, 3 to 4 percent aluminum and 8 to 15 percent zirconium, and the balance nickel.

3. The alloy of claim 1 comprising in atomic percent about 32 to 40 percent titanium, 3 to 4 percent aluminum and 9 to 17 percent hafnium, and the balance nickel.

4. The alloy of claim 1 comprising in atomic percent about 47 percent titanium, about 3 percent aluminum, about 5 to 20 percent palladium, and the balance nickel.

5. The alloy of claim 1 comprising in atomic percent about 47 percent titanium, about 3 percent aluminum, about 5 to 20 percent platinum, and the balance nickel.

6. The alloy of claim 1 having a $T_0$ temperature in the range of about −40° C. to about 100° C.

7. The alloy of claim 6 having a $T_0$ temperature of less than about 35° C.

8. The alloy of claim 1 wherein the alloy is comprised of at least about 40 atomic % nickel and about 40 atomic % titanium in combination with less than about 5 atomic % aluminum and less than about 15 atomic % zirconium, said alloy characterized by shape memory transformation at a temperature in the range of about −40° C. to 100° C.

9. The shape memory alloy of claim 1 comprising in combination in atomic percent:

about 32 to 47 percent titanium;

about 3 to 4 percent aluminum;

one or more materials in the form of a coherent, nanodispersed phase taken from the group consisting of about 8 to 15 percent zirconium, 5 to 20 percent palladium, 5 to 20 percent platinum, 5 to 20 percent hafnium and mixtures thereof; and the balance nickel.

10. The alloy of claim 9 further including one or more additive materials in atomic percent selected from the group consisting of:

less than 1% boron, less than 9% niobium; and less than about 500 ppm oxygen and less than about 500 ppm carbon.

11. The alloy of claim 9 comprising in atomic percent about 47 percent titanium, about 3 percent aluminum, about 5 to 20 percent palladium, and the balance nickel.

12. The alloy of claim 9 comprising in atomic percent about 47 percent titanium, about 3 percent aluminum, about 5 to 20 percent platinum, and the balance nickel.

13. The alloy of claim 9 comprising in atomic percent about 32 to 40 percent titanium, about 3 to 4 percent aluminum and about 8 to 15 percent zirconium.

14. The alloy of claim 1 further including an additional, multi-component bcc β Nb—Ti phase as a buffer for excess titanium.

15. A shape memory alloy comprising in combination in atomic percent:

about 30 to 40 percent titanium;

about 3 to 4 percent aluminum;

one or more materials in the form of a coherent nanodispersed phase taken from the group consisting of about 8 to 15 percent zirconium, 9 to 17 percent hafnium and mixtures thereof, where the sum of titanium, aluminum, hafnium and zirconium is about 50 atomic percent; and the balance nickel.

16. A shape memory alloy comprising in combination in atomic percent:

about 47 percent titanium;

about 3 percent aluminum; and one or more materials in the form of a coherent nanodispersed phase taken from the group consisting of about 5 to 20 percent palladium, 5 to 20 percent platinum and mixtures thereof; and the balance nickel where the sum of nickel, palladium, and platinum is about 50 atomic percent.

* * * * *

UNITED STATES PATENT AND TRADEMARK OFFICE

CERTIFICATE OF CORRECTION

PATENT NO. : 7,316,753 B2 
APPLICATION NO. : 10/809082
DATED : January 8, 2008
INVENTOR(S) : Jin-Won Jung and Gregory B. Olson It is certified that error appears in the above-identified patent and that said Letters Patent is hereby corrected as shown below:

On page 1 OTHER PUBLICATIONS,
"Ti-48.2 at. Pct Ni Shape Memory Thin Flims" should read --Ti-48.2 at. Pct Ni Shape Memory Thin Films--
"Kajiwara et al., "Stregthening" should read --Kajiwara et al., "Strengthening--

On column 3 line 38
"betwen" should read --between--

On column 5 line 52,
"y type" should read --gamma type--

On column 9 line 33,
"the To" should read --the $T_0$--

Signed and Sealed this

Seventeenth Day of June, 2008

JON W. DUDAS
*Director of the United States Patent and Trademark Office*

UNITED STATES PATENT AND TRADEMARK OFFICE

CERTIFICATE OF CORRECTION

PATENT NO. : 7,316,753 B2
APPLICATION NO. : 10/809082
DATED : January 8, 2008
INVENTOR(S) : Jin-Won Jung and Gregory B. Olson It is certified that error appears in the above-identified patent and that said Letters Patent is hereby corrected as shown below:

In the Specification

Column 1, line 13:

Insert: --STATEMENT OF FEDERALLY SPONSORED RESEARCH

This invention was made with government support under Award 9806749 from the National Science Foundation. The government has certain rights in this invention.--

Signed and Sealed this
Twelfth Day of November, 2013

Teresa Stanek Rea

Teresa Stanek Rea
*Deputy Director of the United States Patent and Trademark Office*